US006893696B2

(12) United States Patent
Hansen et al.

(10) Patent No.: US 6,893,696 B2
(45) Date of Patent: May 17, 2005

(54) RUPTURABLE SEAL

(75) Inventors: Paul E. Hansen, Lake Elmo, MN (US); John W. Rovang, New Ulm, MN (US); Nathan K. Hagen, Austin, TX (US)

(73) Assignee: 3M Innovative Properties Company

( * ) Notice: Subject to any disclaimer, the term of this patent is extended or adjusted under 35 U.S.C. 154(b) by 40 days.

(21) Appl. No.: 10/455,055

(22) Filed: Jun. 5, 2003

(65) Prior Publication Data

US 2004/0247813 A1 Dec. 9, 2004

(51) Int. Cl.[7] ..... B65D 5/54

(52) U.S. Cl. ..... 428/36.2; 428/36.4; 428/365; 428/401; 428/516

(58) Field of Search ..... 428/36.2, 36.4, 428/365, 401, 516

(56) References Cited

U.S. PATENT DOCUMENTS

| | | | | |
|---|---|---|---|---|
| 2,756,875 | A | | 7/1956 | Yochim |
| 2,916,197 | A | | 12/1959 | Detrie et al. |
| 2,932,385 | A | | 4/1960 | Bollmeier et al. |
| 2,971,850 | A | | 2/1961 | Barton |
| 3,074,544 | A | | 1/1963 | Bollmeier et al. |
| 3,809,224 | A | | 5/1974 | Greenwood |
| 3,978,185 | A | | 8/1976 | Buntin et al. |
| 4,379,192 | A | | 4/1983 | Wahlquist et al. |
| 4,462,224 | A | | 7/1984 | Dunshee et al. |
| 4,813,948 | A | | 3/1989 | Insley |
| 4,865,854 | A | * | 9/1989 | Larson ..... 426/107 |
| 4,921,645 | A | | 5/1990 | Insley |
| 4,961,495 | A | | 10/1990 | Yoshida et al. |
| 5,287,961 | A | | 2/1994 | Herran |
| 5,804,512 | A | | 9/1998 | Lickfield et al. |
| 5,954,230 | A | | 9/1999 | Blette et al. |
| 2002/0187329 | A1 | | 12/2002 | Ista et al. |

FOREIGN PATENT DOCUMENTS

| | | |
|---|---|---|
| DE | 77 23 214 | 10/1977 |

OTHER PUBLICATIONS

Van A. Wente, "Superfine Thermoplastic Fibers", *Industrial and Engineering Chemistry,* vol. 48, No. 8, Aug. 1956, pp. 1342–1346.

* cited by examiner

*Primary Examiner*—Sandra M. Nolan
(74) *Attorney, Agent, or Firm*—James J. Trussell

(57) ABSTRACT

A rupturable seal comprising a film of a first polymer, a film of a second polymer and a sealing interlayer. The sealing interlayer has a melting point higher than the melting points of either the first polymer or the second polymer and comprises a plurality of micro-fibers each having an average effective fiber diameter from about 2.5 $\mu$m to about 7.0 $\mu$m. Fusion bonding of films of the first polymer and the second polymer to either side of a sealing interlayer produces a rupturable seal having a frangible interface including portions thereof wherein the first polymer contacts the second polymer. The rupturable seal parts at the frangible interface by application of force causing a gap and separation of the first film from the second film.

13 Claims, No Drawings

RUPTURABLE SEAL

BACKGROUND OF THE INVENTION

1. Field of the Invention

The invention relates to packaged products and means for providing rupturable seals to divide plastic containers into a plurality of compartments. More particularly the present invention provides a rupturable seal, comprising melt-blown micro-fibers, that separate by application of force, causing the seal to rupture to provide an opening that allows interaction of materials previously isolated in separate compartments of a plastic container.

2. Description of the Related Art

A single container may be used for storage of materials that react together if allowed to come into contact with each other. Typically, the single storage container includes means, for example sealed boundaries or barrier strips, and the like, to prevent contact between the reactive materials until there is a need for the product of reaction. The use of seals and barrier strips provides means for separating containers, particularly plastic containers or packages into a number of separate compartments. A variety of liquids or mobile reactive components may be isolated in individual compartments. Disruption of a barrier between compartments provides a pathway for reactive components to intermix and react together. Reaction may be encouraged by hand manipulation of a flexible package.

The use of multi-compartment plastic packages is known for containment of reactive materials including reactive liquid monomers that require separation from activator materials that convert the liquid monomers into cured resin materials. A typical combination of reactive components comprises as a liquid epoxy monomer separated from a stable mixture of a liquid polysulfide polymer and an amine activator for the epoxy monomer. When mixed together, these materials undergo exothermic reaction to produce a heat-resistant, tough resinous product that finds use as an electrical insulating material.

U.S. Pat. No. 2,932,385 discloses a multi-compartment plastic package suitable as a container that keeps a liquid epoxy monomer composition separate from a liquid polysulfide polymer. The package includes two sheets of a thermoplastic film fusion bonded together along the outer edges of the film and divided into compartments by heat-sealing a breaker strip between the films so that it extends to the fused edges of the films. A breaker strip is weaker physically than either of the films, which allows it to break, under stress, before rupture of the fused edge seals of the plastic package. A related patent (U.S. Pat. No. 3,074,544) describes several methods for forming multicompartment packages using a variety of sealing strips.

Other references to multi-compartment plastic packages may be found in, for example, U.S. Pat. No. 2,756,875, U.S. Pat. No. 2,916,197, U.S. Pat. No. 3,809,224, U.S. Pat. No. 4,961,495, and U.S. Pat. No. 5,287,961. Other materials may be stored in multi-compartment plastic containers as described in U.S. Pat. No. 2,971,850 that identifies a multi-compartment package including a rupturable membrane to separate the components of an enzyme system. The package preserves enzyme activity before rupture of the membrane and reaction between the enzyme and an appropriate substrate material.

Regardless of the availability of sealing strip structures, useful for providing separation between compartments of plastic containers, a need exists for seal forming material to lower the cost, improve consistency and increase the efficiency of processes used for manufacturing multi-compartment plastic storage bags having increased shelf life.

SUMMARY OF THE INVENTION

The present invention provides a rupturable strip seal, comprising melt-blown micro-fibers, that separate by application of force, causing the seal to rupture to allow interaction of fluid reactants previously isolated in separate compartments of a plastic container. As indicated, the rupturable seal provides a divider to seal compartments of a plastic bag or pouch or similar container from each other. A multi-compartment plastic bag or pouch provides suitable containment for two or more materials that react on contact to yield useful products such as coating materials, encapsulant materials and bonding materials and the like. Food products may be stored in multi-compartment plastic pouches, particularly when food components are best mixed just before consumption.

Strip seals according to the present invention include substantially a single material, namely meltblown plastic micro-fibers. This differs from the description of breaker strips, in U.S. Pat. No. 2,932,385, which bond together two films on opposite sides of a breaker strip consisting of a central fibrous portion separating outer filmstrips. The outer filmstrips comprise the same thermoplastic polymer as the two films bonded to them on either side of a breaker strip. This produces a filmstrip-to-film seal equally as strong as the seal formed by direct fusion sealing of one film to another. The fibrous central layer provides a weakened plane of the breaker strip, which splits along its central plane when the films are jerked apart. With bursting of the breaker strip, the two filmstrips remain separately attached to different films that form the sides of a plastic package. According to the reference another example of a breaker strip consists of a thin porous paper coated on both surfaces with a thin continuous layer of polyethylene, which heat seals to polyethylene films that form the outer envelope of a multi-compartment package. The paper center of the breaker strip remains porous and susceptible to leakage by premature rupture or separation due to chemical attack. Either of these conditions produces an opening between compartments. Premature rupture leads to undesirable leakage between compartments As indicated above, previously known seals were composite structures having a fibrous portion sandwiched between continuous layers of barrier film of substantially the same chemical composition as thermoplastic sheets of film used to form multi-compartment bag structures. Strip seals according to the present invention are uniform structures formed by cutting strips from melt blown micro-fiber webs wherein effective fiber diameters have a range from about 2.5 $\mu$m to about 7.0 $\mu$m. Effective fiber diameter (EFD) is further defined below showing it to be an approximation of average fiber diameter.

Rupturable strip seals according to the present invention comprise micro-fibers that form an impermeable barrier between two layers of a thermoplastic polymer used to bond bags or plastic pouches by edge sealing sheets of polymer film together. One method for micro-fiber formation uses a known process that disrupts high velocity streams of a thermoplastic polymer to produce small diameter fibers referred to herein as melt-blown micro-fibers.

Bags or plastic pouches according to the present invention preferably use a composite film laminate having a surface of polyethylene adjacent to a surface of polyethylene terephthalate. A rupturable strip seal, used to separate a plastic pouch into two compartments, has a melting point higher than the thermoplastic polymer sheets that it separates. This means that bond formation between a strip seal and a thermoplastic polymer sheet relies upon each sheet melting and flowing into the interstices of the melt-blown micro-fiber strip to produce a bonded structure including an impermeable barrier holding two sheets of thermoplastic polymer together. One preferred embodiment of a multi-compartment pouch includes a strip seal of polypropylene microfibers between layers of polyethylene. Polyethylene wets polypropylene microfibers so there is no need to laminate compatible films of polyethylene on either side of the polypropylene or alternatively to add polyethylene fibers to the strip seal.

Although it is not necessary for the melt-blown micro-fiber strip to melt during sealing, a seal including thermoplastic polymer micro-fibers has sufficient strength, between about 0.1 $Kg/cm^2$ (1.45 psi) and about 1.25 $Kg/cm^2$ (17.5 psi), to prevent solid or liquid transfer through the seal representing the impermeable barrier. However, the melt blown micro-fiber strip seal ruptures under moderate hand stress without damaging the thermoplastic sheets or breaking the bag film edge seals.

An advantage of strip seals of melt blown polymer micro-fibers according to the present invention is the high uniformity of an inert material that provides barrier strip seals of greater reliability and consistency than breaker strips described previously as including a central layer of non-woven or paper material. The manufacture of such breaker strips requires a complex process including at least one additional step to laminate thermoplastic material on either side of the non-woven or paper materials before the resulting breaker strips may be bonded to thermoplastic polymer sheets during package formation. Additional processing steps increase the probability of inconsistent product performance leading to scrap and higher manufacturing costs.

A melt blown polypropylene micro-fiber web according to the present invention is a readily available material obtained by a one-step process that is more controllable than processes used to produce laminates of polymer films and non-woven or paper material. In addition, it is possible to manufacture single layer melt blown polymer micro-fiber webs having controlled levels of basis weight and porosity. Compared to the layered breaker strips of U.S. Pat. No. 2,932,385, single-layer strip seals according to the present invention have no internal interfaces that could fail by premature rupture or separation following chemical attack, for example. Yet another advantage of strip seals formed from melt blown polymer micro-fiber webs is the visual indication of effective barrier seal formation when the sealed junction, between bag compartments, changes from an opaque to a substantially transparent condition. The transition from opaque to transparent provides an observable signal of formation of a barrier seal that provides effective separation between compartments of a plastic package.

A multi-compartment plastic package or bag container according to the present invention may be fabricated to include two sheets of thermoplastic polymeric film and at least one melt blown micro-fiber strip seal. Formation of fused edges, by heat-sealing around the edges of the film sheets produces a hermetically closed envelope. A suitably positioned strip seal, bonded between the two film sheets by application of heat and pressure, represents a barrier to material transfer from a first compartment, on one side of the barrier, to a second compartment on the other side of the barrier.

More particularly the present invention provides a rupturable seal comprising a first polymer having a first melting point, a second polymer having a second melting point, and a sealing interlayer having a first side opposite a second side. The first side of the sealing interlayer includes a first boundary layer bonded to a portion of the first polymer. Also, the second side of the sealing interlayer includes a second boundary layer bonded to a portion of the second polymer. The sealing interlayer has a melting point higher than the first melting point and the, second melting point and comprises a plurality of micro-fibers having an average effective fiber diameter from about 2.5 $\mu$m to about 7.0 $\mu$m. The first boundary layer includes a first portion of the plurality of micro-fibers surrounded by the first polymer. The second boundary layer includes a second portion of the plurality of micro-fibers surrounded by the second polymer. The rupturable seal has a frangible interface between the first boundary layer and the second boundary layer. The rupturable seal parts at the frangible interface by application of a force causing separation of the first boundary layer from the second boundary layer.

Definitions

Terms used herein have the meanings indicated as follows:

The term "micro-fiber" refers to fibers for which the average diameter is from about 1.0 $\mu$m to about 10.0 $\mu$m.

The term "effective fiber diameter" is a calculated dimension, known to one of ordinary skill in the art, derived from the pressure drop across a microfiber web of known thickness, polymer density and basis weight.

Terms such as "rupturable seal" or "barrier seal" or the like refer to a composite structure comprising at least two layers of thermoplastic polymer bonded to the sides of a strip seal according to the present invention. A rupturable seal includes boundary layers produced by infusion of molten thermoplastic polymer into spaces between microfibers forming side portions of a strip seal.

The terms including "strip seal," or "separator strip seal," or "microfibrous strip seal," or "sealing interlayer," or the like refer to a blown micro-fiber web, converted into strip form for use in the formation of rupturable seals between suitable layers of polymer film or film laminates used for fabricating multi-compartment packages according to the present invention.

A "boundary layer" forms on either side of a barrier seal when molten polymer infuses into a strip seal to provide, on cooling, a polymer-filled side portion of the strip seal.

The term "frangible interface" refers to the central portion of a barrier seal, between boundary layers, wherein the frangible interface includes micro-fibers substantially free of thermoplastic polymer. This provides a relatively weak interface that preferentially parts during forced separation of opposing boundary layers. In an exemplary embodiment, the frangible interface includes portions thereof wherein the first polymer contacts the second polymer. In another exemplary embodiment, depending on the bonding temperature, molten polymer could substantially fill the internal space of a strip seal. This condition prevents preferential parting of a frangible interface. Preferably a major portion of a frangible interface is a micro-fiber-containing gap between boundary layers.

DETAILED DESCRIPTION OF THE INVENTION

As required, detailed embodiments of the present invention are disclosed herein; however, it is to be understood that the disclosed embodiments are merely exemplary of the invention that may be embodied in various and alternative forms. Specific structural and functional details disclosed herein are not to be interpreted as limiting, but merely as a basis for the claims and as a representative basis for teaching one skilled in the art to variously employ the present invention.

A multi-compartment plastic package or bag container according to the present invention may be fabricated to include two sheets of thermoplastic polymeric film and at least one melt blown micro-fiber strip seal. Depending upon the duration and pressure of bonding, layers of polyethylene, or other suitable thermoplastic, fuse together at temperatures between about 120° C. and about 200° C. to form fused, heat-sealed margins around the edges of the film sheets, producing an hermetically closed envelope. A suitably positioned strip seal, bonded between the two film sheets represents a barrier to material transfer from a first compartment, on one side of the barrier, to a second compartment on the other side of the barrier. The sizes and positions of the two compartments depend upon the position of the strip seal inside the plastic package. It will be appreciated that additional strips seals positioned between the two film sheets will increase the number of compartments in a bag container.

Suitable film materials for multi-compartment plastic packages according to the present invention may be selected from a group of polymer films and film composites including a suitable heat-seal layer. Formation of barrier seals according to the present invention may use any of a wide range of thermoplastic polymers to provide bonding layers melting below or close to the melting point of a microfibrous strip seal. Suitable materials may be selected from, for example, polyolefin polymers including polyethylene and polypropylene, polyvinyl chloride, and ethylene vinyl acetate and film composites including any of these materials laminated with films of polymers, such as polyethylene terephthalate that melts above the melting point of a strip seal.

Manufacture of a blown microfiber polymer web preferably relies upon a method of the type described by Van Wente in Industrial and Engineering Chemistry Vol. 48, No. 8, 1956, p. 1342. U.S. Pat. No. 3,978,185 describes a similar but improved method that reduces the amount of undesirable coarse "shot" or "beads" of material larger than about 0.3 mm in diameter. The manufacturing method has been shown to yield fibers as fine as 0.1 $\mu$m to 1.0 $\mu$m for various thermoplastic materials including nylon, polyolefins, polystyrene, poly(methyl methacrylate), poly(ethylene terephthalate), and polytrifluorochloroethylene. Fiber formation requires the use of an apparatus that is essentially a ram-extruder that forces molten material through a row of fine orifices and directly into two converging, high velocity streams of heated air or other appropriate gas. Air temperature and polymer-melt temperature have separate adjustment, as do the velocities of the streams of air and thermoplastic fluid materials.

A resin, ejected from a extruder nozzle at a temperature between about 290° C. (550° F.) and 430° C. (800° F.), enters a gas stream as molten strands of resin that the gas stream attenuates into fibers. Fibers form at a point that lies within the gas stream where cooling has progressed sufficiently to solidify the resin material. Since the hot-melt resin issues from the nozzle directly into the confluence of the two air streams, the greatest amount of attenuation occurs at this point of exit. Depending upon the exact temperatures and velocities used, the fibers cool to a solid form after being carried by the air stream to about 2.5 cms away from the nozzle tip.

Newly formed fibers move away from the nozzle in a dispersed turbulent stream at very high velocity. With typical air conditions of about 315° C. (600° F.) and about 3.5 $Kg/cm^2$ (50 psi), this velocity might equal or exceed sonic velocity, i.e. about 500 meters per second (1600 feet per second). A moving 16 mesh screen provides a surface that separates the air blast from the fibers to provide a random deposit of fibers that may be stripped from the screen as a fiber mat for collection on a wind-up reel, with or without being densified using press rolls. Melt blown polymer webs, preferably polypropylene webs, suitable for fabrication of strip seals according to the present invention have an effective fiber diameter (EFD) from about 2.5 $\mu$m to 7.0 $\mu$m, preferably 4.0 $\mu$m to 6.0 $\mu$m.

A convenient package for storing reactive materials, particularly fluid materials, comprises at least two layers of thermoplastic polymeric film edge-bonded to each other. Separation of reactive materials requires one or more rupturable seals, also referred to herein as a strip seals that form barriers to movement of reactive materials between isolated compartments within the package. The material of a strip seal typically has a melting point higher than the film layers used to form the package. This melting point differential provides fused edge bonds formed by heating the thermoplastic films until they melt and fuse together. Controlled heating of film layers against a strip seal according to the present invention causes the film layers to melt and flow into the sides of the separator strip seal at temperatures higher than the melting point of the films but lower than the melting point of the separator seal material. Film layers bond to the strip seal as the laminated structure cools to provide a rupturable seal.

The seal formed by bonding plastic film to a melt blown micro-fiber strip seal, as described above, has sufficient strength to completely separate reactive material of one compartment from reactive material in another compartment of an envelope during normal handling, shipping and storing operations. A multi-compartment plastic package according to the present invention maintains the required seal, in a two-part bag container, or multiple seals, in a bag having more than two compartments, until there is a need to intermix the reactive materials. The mixing process may be conveniently activated by gripping a portion of film on either side of a strip seal and jerking the films in opposite directions to disrupt the structure of the melt blown microfiber strip, which ruptures the seal and allows material migration through the open seal. Complete mixing of material involves hand manipulation of the flexible plastic package. From the description of the sequence of actions for mixing reactive materials inside a bag container, it should be apparent that the edge seals between the sheets of thermoplastic film will be stronger than the internal strength of the melt blown micro-fiber layer remaining inside a strip seal after bonding it between sheets of thermoplastic film. Preferential rupture of a strip seal according to the present invention avoids the possibility of leakage of reactive materials following inadvertent disruption of an edge seal of a plastic package.

The formation of a heat seal between portions of thermoplastic film sheets and a strip seal according to the present invention requires a series of process steps including inserting a strip of melt blown micro-fiber web between two lengths of film. This produces a sandwich construction having a narrow strip of micro-fibers extending between two lengths of film each having a width greater than that of the strip of micro-fibers, so that the edges of the films overlap the edges of the strip of seal-forming micro-fibers. Film sheets bond to the micro-fiber strip following positioning of the sandwich construction between a pair of heated platens. Each platen includes individually controlled, heated rails aligned with the strip seal and along parallel edges and across the width of the film sandwich. The positioning and number of heated rails depends upon the design of a multi-compartment packaging container. After closing the heated platens around the film construction, application of pressure causes the film layers to bond to the strip seal and to fuse together along the edges and across the width of the films. The platen press produces a bag sealed along its parallel edges and its base and having at least one barrier seal separating a number of compartments. A multi-compartment bag, as described above, has an opening to each compartment for addition of materials that require separation to prevent premature reaction. After placing materials in their respective compartments, the open ends of a multi-compartment package may be sealed using a second platen press that includes a heated rail to form a final edge seal. The temperature for edge seal formation may be high enough to produce a fused junction at the intersection between the edge seal and a strip seal according to the present invention. Formation of fused junctions of this type provides an advantage compared to previously known breaker seals including paper tissue. A junction including a paper strip does not form a fused junction and may introduce a point of failure at temperatures, which cause paper charring.

A preferred embodiment according to the present invention uses a platen press temperature typically in a range from about 140° C. to about 150° C. This temperature range is above the melting points of the thermoplastic layers in contact with a strip seal but below the melting point of the melt blown micro-fiber strip seal itself. The heating time is from two seconds to four seconds depending upon the pressure applied to the plates of the platen press. Suitable application of heat and pressure causes melting of the thermoplastic layer and migration of molten polymer into the interstices of the micro-fibers to produce boundary layers, on either side of the seal strip, containing molten polymer that solidifies as it cools. Thermoplastic polymer flowing from one side of a strip seal may make contact with polymer flowing from the opposite side. However, it is preferred that boundary layers do not merge as this would produce, upon cooling, a solid polymer filled strip seal with a bond strength similar to fused edge seals. Effective bonding between a strip seal and package films leaves at least an internal portion of the strip seal free from thermoplastic polymer to provide a frangible interface at which the rupturable seal strip parts during application of force to the plastic package causing separation of the boundary layers of the strip seal. In an exemplary embodiment, the frangible interface includes portions thereof wherein the first polymer contacts the second polymer. In another exemplary embodiment, depending on the bonding temperature, molten polymer could substantially fill the internal space of a strip seal. This condition prevents preferential parting of a frangible interface. Preferably a major portion of a frangible interface is a micro-fiber-containing gap between boundary layers.

An alternate process for forming a heat seal between portions of thermoplastic film sheets and a strip seal according to the present invention requires a series of steps of a continuous process including inserting a strip of melt blown micro-fiber web between two lengths of film. This produces a sandwich construction having a narrow strip of micro-fibers extending between two lengths of film each having a width greater than the strip of micro-fibers, so that the edges of the films overlap the edges of the strip of seal-forming micro-fibers. Film sheets bond to the micro-fiber strip during movement of the sandwich construction between rollers aligned along the strip seal and heated to an elevated temperature. The duration of contact of the thermoplastic film sheets with the heated rollers causes melting of the thermoplastic layer and migration of molten polymer into the interstices of the micro-fibers to produce boundary layers, on either side of the strip seal, containing molten polymer that solidifies as it cools.

The continuous strip formed as described above may enter another heat sealing device that produces peripheral seals by application of heat and pressure along the edges of the overlapping films and across the film structure as needed to provide plastic packages having two compartments separated by a strip seal according to the present invention. One edge of each compartment remains open for charging of reactive materials, after which a heat sealer forms the final fused edge seal that closes the compartments and isolates the reactive materials from each other.

Melt blown micro-fiber webs, used for forming strip seals according to the present invention, include non-woven, fibrous polymeric materials, preferably a polypropylene homopolymer #3957, having a melt flow rate from about 280–420 g/10 minutes at 230° C. (available from Atofina, Houston, Tex.). Micro-fiber webs typically have basis weights ranging from about 10 grams per square meter (gsm) to about 30 gsm, preferably about 25 gsm, and a range of effective fiber diameters from about 2.5 $\mu$m to about 7.0 $\mu$m. Strip seals according to the present invention introduce less of a bump between packaging films and other seals, e.g. edge seals. A strip seal between about 1.0 cm and 1.25 cm wide, having a basis weight of 15 gsm, has a thickness of 100 $\mu$m before sealing. After sealing, a strip seal separator has a thickness of about 25 $\mu$m (0.001 inch).

The porosity of a melt blown micro-fiber web depends upon basis weight and fiber diameter. These characteristics control the rate of flow of molten polymer into the interstices between micro-fibers, during the process of bonding packaging film sheets to either side of a micro-fiber strip seal. After successful formation of heat sealed container bags, the strength of a barrier seal may be evaluated using a pressurized bag-bursting machine. The test includes inflating the compartments on either side of a strip seal to an air pressure at which the melt blown micro-fiber seal bursts. A preferred range of seal strength is from about 0.21 $Kg/cm^2$ (3.0 psi) to about 0.63 $Kg/cm^2$ (9 psi).

Package-forming polymers suitable for use according to the present inventions include polymer films having a lower melting point than the polymer used to form a melt blown micro-fiber web. As a preferred example, a multi-compartment envelope uses a film laminate identified by the trade name SCOTCHPAK 29905 available from 3M Company, St. Paul, Minn. The film laminate includes a layer of polyethylene adjacent to a layer of polyethylene terephthalate. Orientation of SCOTHPAK 29905 film during formation of a multi-compartment pouch places the polyethylene layer as the inner layer that bonds to a strip seal during heating between about 120° C. and about 200° C. to form a barrier seal.

Various fluid components may be enclosed in the separate compartments of a multi-compartment package. A typical and preferred combination of reactive components comprises as a first material a liquid polyol resin and as a second material an isocyanate crosslinking agent. These materials react to form a polyurethane encapsulating or blocking compound. A second combination of reactive components comprises a liquid having anhydride functionality. The liquid reacts with a suitable crosslinking agent to provide a polyester encapsulant material. Component materials that react to form an epoxy resin may also be stored in multi-compartment packages. In this case the package separates a liquid, epoxy-functional, composition from a mixture of a liquid polymer and amine activator prior to formation of the epoxy resin. Activation of the reaction between resin-forming components involves gripping the outer packaging films close to the central area of one of the compartments and jerking the films apart along the axis of the rupturable seal. This breaks the strip seal by fiber separation in the frangible interface between the boundary layers of the strip seal without damaging the permanent fused edge seals of the package. Rupture of the frangible interface permits the reactive contents of the package to combine. Homogeneous mixing may require hand manipulation of the packaging envelope to promote the resin-forming reaction. Removal of a corner of the package provides an opening for release of the reacting mixture that may be dispensed into a waiting mold or other cavity or container wherein the reaction continues to completion. As an alternative to removing a corner from a multi-compartment package, a nozzle closure may be built into one of the film sheets used to produce the package.

Multi-compartment packages according to the present invention may be used as flexible container bags for materials that react together to produce resins for a variety of uses including resins for application in telecommunications systems, particularly as encapsulant materials. Chemical resistance testing of a melt blown micro-fiber strip seal with different encapsulating resin systems showed no damage to the seal during oven-aging at an elevated temperature of 65.5° C. (150° F.) with the multi-compartment package supporting a weight of 1 Kg.

Experimental

A two compartment bag, formed by heat sealing a strip seal of melt blown polypropylene web down the center of a polyethylene bag may be tested using either ASTM-F88-00 or ASTM-F2054-00 to determine the strength of the resulting barrier seal. The first of these tests (ASTM-F88-00) measures seal strength of flexible barrier bags. Burst strength measurement uses internal pressurization within restraining plates as described by the second test method (ASTM-F2054-00).

Comparison of Blown Micro-Fiber (BMF) Barrier and Effective Fiber Diameter (EFD).

Bag dimensions: Width—19.7 cms Length—11.4 cms.

Bags including a lengthwise barrier strip were manufactured on a Klockner-Ferromatik Bag Maker, Model LA III. The process included platen press activation using a temperature between about 135° C. and about 150° C., a dwell time setting between about two seconds to about four seconds and a machine pressure setting of 1.54–1.97 Kg/cm$^2$ (22–28 psi). Bags of Examples 1–12 were burst using an ARO 2600 pressurized air burst machine with a flow rate setting of 9.0. Examples 1–6 of Table 1 show that at a fixed temperature the barrier burst strength increases with effective fiber diameter increase.

TABLE 1

Burst Strength of BMF Webs Strip Seals of Examples 1–6

| | Example | | | | | |
|---|---|---|---|---|---|---|
| | 1 | 2 | 3 | 4 | 5 | 6 |
| Sealing temperature ° C. | 135 | 135 | 135 | 140.5 | 140.5 | 140.5 |
| EFD (microns) | 4.7 | 4.5 | 4.0 | 4.7 | 4.5 | 4.0 |
| Basis weight (g/m$^2$) | 25 | 25 | 25 | 25 | 25 | 25 |
| Barrier burst strength (Kg/cm$^2$) | 0.22 | 0.12 | 0.10 | 0.45 | 0.30 | 0.22 |

TABLE 2

Burst Strength of BMF Webs Seats of Examples 7–12

| | Example | | | | | |
|---|---|---|---|---|---|---|
| | 7 | 8 | 9 | 10 | 11 | 12 |
| Sealing temperature ° C. | 140 | 140 | 146 | 146 | 146 | 146 |
| EFD (microns) | 6–8 | 6–8 | 4.7 | 4.5 | 4.4 | 4.0 |
| Basis weight (g/m$^2$) | 20 | 30 | 25 | 25 | 25 | 25 |
| Barrier burst strength (Kg/cm$^2$) | 0.74 | 0.50 | 0.49 | 0.44 | 0.41 | 0.34 |

Examples 7–12 of Table 2 show that at a fixed temperature the barrier burst strength increases with effective fiber diameter increase and also with lowering of basis weight. Comparison between the results of Table 1 and Table 2 indicate that barrier burst strength increases as the sealing temperature increases.

Blown Micro-Fiber (BMF) Barrier Basis Weight Comparison

Examples 13–23 Bag dimensions: Width—25.4 cms Length—26.7 cms.

Bags were manufactured on a Klockner-Ferromatik Bag Maker, Model LA III. The process included platen press activation using a dwell time setting about two seconds to about four seconds. The machine pressure setting was 1.54–1.97 Kg/cm$^2$ (22–28 psi). During bag manufacture feeding of the strip seal web between film sheets could optionally be machine fed, using a barrier strip unwinder, or hand fed. The bags were burst using an ARO 2600 pressurized air burst machine.

Table 3 shows at a fixed temperature that the barrier seal burst strength increases with effective fiber diameter increase and also with lowering of basis weight of the micro-fiber web. Table 4 shows that bags formed using machine fed strip seal differed in burst strength from those manufactured using a hand feeding technique. The difference may be attributed to a difference in strip seal tension during feeding.

TABLE 3

Burst Strength of BMF Webs Seals of Examples 13–16

| | Example | | | |
|---|---|---|---|---|
| | 13 | 14 | 15 | 16 |
| Sealing temperature ° C. | 140 | 140 | 140 | 140 |
| Basis weight | 20 | 30 | 25 | 30 |

TABLE 3-continued

Burst Strength of BMF Webs Seals of Examples 13–16

| | Example | | | |
|---|---|---|---|---|
| | 13 | 14 | 15 | 16 |
| EFD | 6–8 | 6–8 | 5.0 | 5.0 |
| Burst strength-hand fed ($Kg/cm^2$) | 1.23 | 1.12 | 0.42 | 0.46 |

TABLE 4

Burst Strength of BMF Webs Seals of Examples 17–23

| | Example | | | | | | |
|---|---|---|---|---|---|---|---|
| | 17 | 18 | 19 | 20 | 21 | 22 | 23 |
| Sealing temperature ° C. | 146 | 146 | 146 | 146 | 146 | 146 | 146 |
| Basis weight | 20 | 25 | 30 | 25 | 30 | 25 | 30 |
| EFD | 4.7 | 4.7 | 4.7 | 4.5 | 4.5 | 4.0 | 4.0 |
| Burst strength-hand fed ($Kg/cm^2$) | 0.5 | 0.29 | 0.23 | — | — | — | — |
| Burst strength-machine fed ($Kg/cm^2$) | — | — | — | 0.45 | 0.40 | 0.52 | 0.51 |

As required, details of the present invention are disclosed herein; however, it is to be understood that the disclosed embodiments are merely exemplary. Reference to the use of multi-compartment bags for separating reactive components for cured resins is not to be interpreted as limiting. For example, another potential use for multi-compartment bags according to the present invention involves separation of food components that require mixing just before use to assure optimum flavor. Description of particular embodiments merely provides a basis for the claims and an information source for teaching one skilled in the art to variously employ the present invention.

What is claimed is:

1. A rupturable seal comprising:

a first polymer having a first melting point;

a second polymer having a second melting point; and a sealing interlayer having a first side opposite a second side, said first side including a first boundary layer bonded to a portion of said first polymer, said second side including a second boundary layer bonded to a portion of said second polymer, said sealing interlayer having a melting point higher than said first melting point and said second melting point, said sealing interlayer comprising a plurality of micro-fibers having an average effective fiber diameter from about 2.5 $\mu$m to about 7.0 $\mu$m, said first boundary layer including a first portion of said plurality of micro-fibers surrounded by said first polymer, said second boundary layer including a second portion of said plurality of micro-fibers surrounded by said second polymer, said rupturable seal having a frangible interface between said first boundary layer and said second boundary layer, said rupturable seal parting at said frangible interface by application of a force causing separation of said first boundary layer from said second boundary layer.

2. The rupturable seal of claim 1, wherein said first polymer and said second polymer are polyethylene.

3. The rupturable seal of claim 1, wherein said plurality of micro-fibers comprise polypropylene.

4. The rupturable seal of claim 3, wherein said average effective fiber diameter is from about 4.0 $\mu$m to about 5.0 $\mu$m.

5. The rupturable seal of claim 4, wherein said plurality of micro-fibers form a polypropylene web having a basis weight from about 10 $g/m^2$ to about 30 $g/m^2$.

6. The rupturable seal of claim 3, wherein said force is from about 0.10 $Kg/cm^2$ to about 1.25 $Kg/cm^2$.

7. The rupturable seal of claim 6, wherein said force is from about 0.21 $Kg/cm^2$ to about 0.63 $Kg/cm^2$.

8. The rupturable seal of claim 1, wherein said frangible interface includes portions thereof wherein the first polymer contacts the second polymer.

9. The rupturable seal of claim 1, wherein a major portion of said frangible interface comprises a micro-fiber-containing gap between said first and second boundary layers.

10. The rupturable seal of claim 1, wherein said first and second polymers substantially fill said sealing interlayer.

11. The rupturable seal of claim 1 in combination with a multicompartment package, wherein said sealing interlayer separates a first compartment of said package from a second compartment of said package.

12. The rupturable seal of claim 11, wherein said first compartment includes a first reactive material therein, and said second compartment includes a second reactive material therein.

13. The rupturable seal of claim 12, wherein upon said rupturable seal parting at said frangible interface by application of a force causing separation of said first boundary layer from said second boundary layer, said first reactive material intermixes with said second reactive material therein.

* * * * *